US006561100B1

(12) United States Patent
Buse et al.

(10) Patent No.: US 6,561,100 B1
(45) Date of Patent: May 13, 2003

(54) METHOD OF PRINTING ON COMPOSITE SUBSTRATES

(76) Inventors: Raymond Buse, 1616 E. Harvard, Phoenix, AZ (US) 85006; William J. Gartland, 6708 Bowman Ave., Youngstown, OH (US) 44515

( * ) Notice: Subject to any disclaimer, the term of this patent is extended or adjusted under 35 U.S.C. 154(b) by 0 days.

(21) Appl. No.: 09/955,249

(22) Filed: Sep. 11, 2001

(51) Int. Cl.[7] ..... B41F 23/04

(52) U.S. Cl. ..... 101/487; 101/491; 101/488; 427/258; 428/295.1

(58) Field of Search ..... 101/487, 488, 101/491, 35, 450.1; 428/295.1, 295.4, 297.1, 299.1, 301.4; 427/258, 259, 261

(56) References Cited

U.S. PATENT DOCUMENTS 5,090,149 A * 2/1992 Muk Kim ..... 43/18.1 R
5,885,173 A * 3/1999 Keller ..... 101/491
6,101,934 A * 8/2000 Makin ..... 101/35
6,244,176 B1 * 6/2001 Sonobe et al. ..... 101/177

FOREIGN PATENT DOCUMENTS

JP 5-147145 * 6/1993

* cited by examiner

*Primary Examiner*—Leslie J. Evanisko
(74) *Attorney, Agent, or Firm*—Gregory J. Nelson

(57) ABSTRACT

A method of printing on composite substrates particularly composite substrates of the type having a matrix impregnated with a resin such as an epoxy. The method is particularly applicable to carbon fiber substrates known as "pregs" or "pre-pregs." The substrate is maintained in a cooled condition, is sheeted and provided with a carrier. The surface is top coated with a UV curing ink. After curing, an image is applied using UV curable inks. After printing, the substrates are maintained in a cold condition for subsequent processing into items such as tubes, rods or the like.

14 Claims, 2 Drawing Sheets

METHOD OF PRINTING ON COMPOSITE SUBSTRATES

FIELD OF THE INVENTION

The present invention relates to a printing method and the resulting product and more particularly relates to a method for printing on composite substrates of the type consisting of fibers or fabric impregnated with a resin.

BACKGROUND OF THE INVENTION

Composite materials are becoming more widely used because of their versatility and mechanical characteristics. Composite materials were originally developed by the defense and aerospace industry for high technology applications. However, in recent years these materials are becoming utilized in a wide range of applications such as for use as arrow shafts, golf club shafts, fishing rods, baseball bats, airframe structure, tool handles, boat hulls as well as many others. Generally composites consist of either fibers or woven fabric with a matrix-treated or impregnated with a resin. The resin is generally a polymer and may be a thermosetting or thermo plastic material. Thermosetting modified epoxies are often used as the matrix resin to create a composite substrate having the desired mechanical properties of tensile strength, tensile modulus, shear strength, flexural strength, flexural modulus, compression strength and compression modulus. One particularly useful type of composite is termed the "carbon preg" or "prepreg." These terms refer to a material having a carbon substrate, generally a dry uni-directional carbon fiber, which is impregnated with low-temperature-curing thermosetting epoxies.

These composite substrates, which will be generally referred to as "prepregs" or "pregs" are often fabricated into tubular structures such as arrow shafts, golf shafts, fishing rods and other items as mentioned above. Manufacturers of these items often wish to apply graphics such as logos, manufacturer's names or aesthetically enhancing designs to the surface of these items. However, these types of composite substrates, and particularly carbon and carbon pregs, do not lend themselves to conventional printing techniques. These substrates are generally fragile and will easily disintegrate or degrade prior to their being fabricated into a finished product. Therefore it is not practical using current technology to apply images to these types of substrates in sheet or roll form prior to fabrication. Once the item has been formed into a finished or semi-finished product, such as a rod or tube, the resulting shape does not lend itself to printing. Further, the completed product has a surface which is generally resistant to application of printing inks, paints and other decorative material. Pad and silk-screening processes have been used to some extent.

A search of the prior art indicates there is very little prior art in the area of printing or applying graphics to composite substrates, other than decals and wraps, particularly substrates of the carbon prepreg type.

In U.S. Pat. No. 5,090,149 is representative of the prior art approach of applying designs, graphics or images to the surface of an item such as a tubular, cylindrical carbon fiber rod. The prior art approach has been to provide a flexible wrapper having a predetermined design thereon. The wrapper is wound around the outer surface of the tubular rod and covered with a transparent preservative coating such as varnish, lacquer, shellac or polyurethane. Such a procedure is expensive, time consuming and increases the weight of the ultimate product. The latter has particular disadvantages in products such as golf club shafts.

In view of the foregoing, there exists the need for a printing process which will allow graphic images or designs to be applied directly to a substrate, such as a prepreg, prior to fabrication into a completed item. Accordingly, the present invention provides a process in which the resulting fabricated item such as a tube, cylinder or flat or curved surface, once formed, displays high quality graphic images without the requirement of externally applying a decal, wrapper or covering to the item.

BRIEF SUMMARY OF THE INVENTION

Briefly, the present invention provides a process for printing on composite substrates, particularly composite substrates of the type having a matrix impregnated with a resin such as a thermosetting modified epoxy. The process has particular application to carbon fiber impregnated substrates of the type known as pregs or prepregs. Such substrates, are fragile and will degrade under higher temperatures. According to the present invention, the composite substrate is maintained in a cold condition, preferably below 40° F. Preferably the substrate material is maintained in a refrigerated condition subsequent to manufacture and is generally provided to the printer in roll form. Upon receipt by the printer, the material is sheeted into sheets from a roll. If the material has not been provided with a backing or carrier such as a release liner of paper is applied to one surface and adhered by application of pressure creating a laminate assembly. If necessary, the substrate with the liner is trimmed so that the substrate does not extend beyond the edges of the liner so as to prevent damage and unraveling of the substrate. The surface of the substrate is then coated with a top coating, which provides a base for the image. The coating may be applied by brushing, spraying, rolling or screening application. Preferably the base coating is a UV (ultra violet) curing ink. The base coating is cured and thereafter the coated surface may be printed with any desired graphic image by any number of printing processes such as lithography, screen printing, rotary letter press, flexography, rotogravure or web printing. UV curable inks, as for example containing acrylates photoinitiators, pigments, titanium dioxide and carbon black. The graphics, once applied, are cured by exposure to UV. When the printing and curing operations are completed, the printed composite substrates are returned to cold storage, preferably below 40° F. and maintained in the cold storage, ready for subsequent processing into items such as tubes, cylinders or flat or curved surfaces on which the outer surface will display the graphic images.

BRIEF DESCRIPTION OF THE DRAWINGS

The above and other objects and advantages of the present invention will be more fully understood from the following description, claims and drawings in which:

DETAILED DESCRIPTION OF THE DRAWINGS

The present invention is applicable to substrates of the type generally designated as composites designated by the numeral 10. These substrates may consist of either a woven fabric such as polyester fabric, or may be in the form of fibers such as carbon fibers, which are uni-directional and formed in sheet form. These composites, in order to achieve the desired mechanical characteristics, tensile strength, tensile modulus, shear strength, flexural strength, flexural modulus, compression strength and compression modulus, are impregnated with polymers. Typical polymers are epoxies, both thermosetting and thermo plastic. One material to which the present process is particularly applicable is the type of substrate generally designated in the industry as large Tow carbon fiber prepreg having a matrix resin which is a thermosetting modified epoxy. The impregnated substrates, as described above, are available and known to those in the industry. For example, large Tow carbon fiber prepregs are available from companies such as Zoltek Materials Group of San Diego, Calif.

The substrate 10 is usually provided on a roll 12 on a cardboard core having a backing or carrier 16 such as a paper adhered to one surface. The substrate, in this form, is then ready for application of graphic images. After fabrication, and prior to application of images, the substrate and release liner are maintained in cold storage at preferably below 40° F. This is necessary because these type substrates, particularly those of the carbon fiber type, are fragile. The backing will assist to reduce the possibility of damage such as tearing or separation of the fibers. Further, maintaining the substrate in cold temperature will minimize the tackiness of the surface to which print is being applied as the matrix resins are catalyzed and the cold temperatures will minimize or prevent further catalytic reaction.

Figure 1:
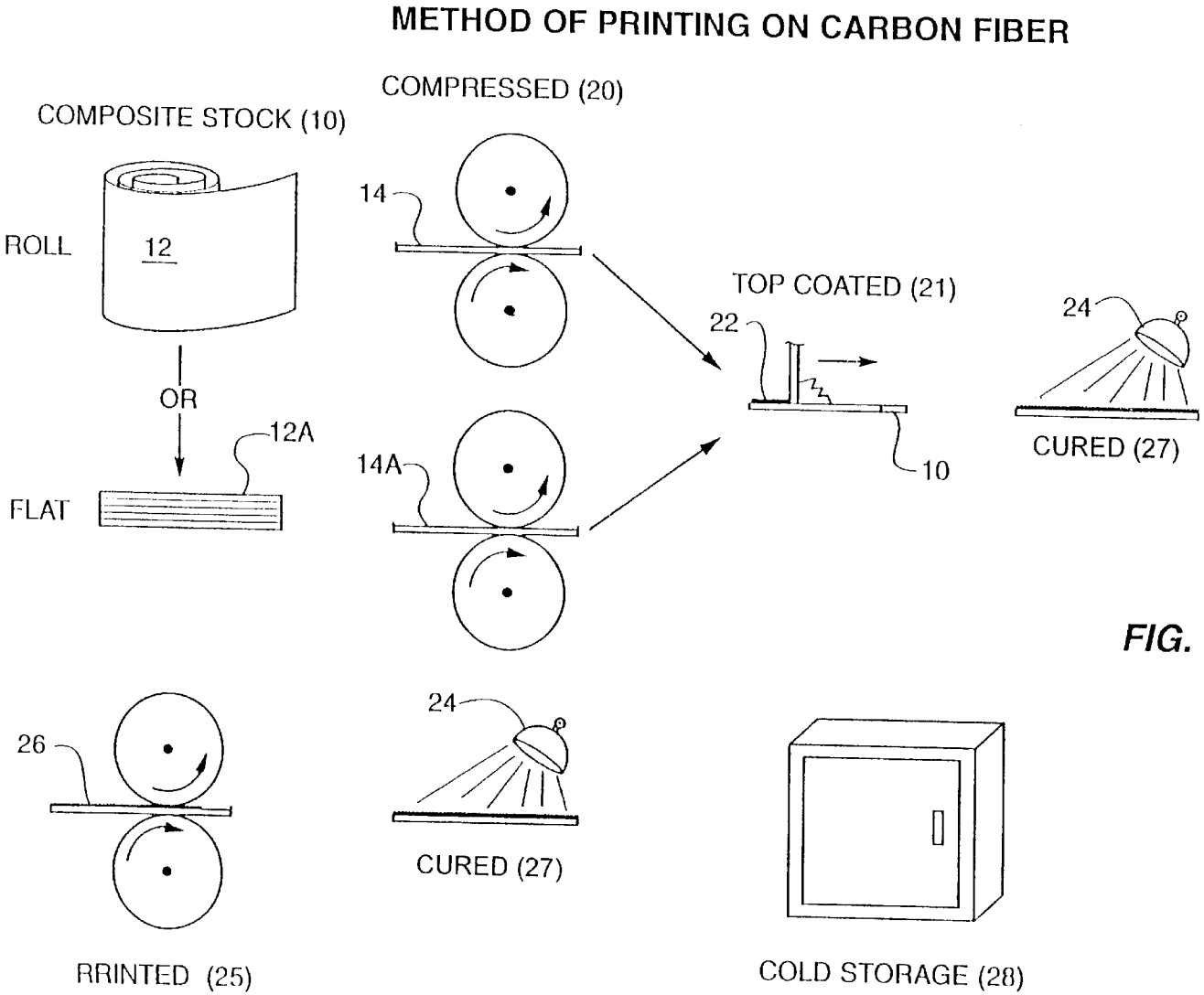
FIG. 1 is a schematic diagram illustrating the method of the present invention.

Referring to FIG. 1, generally the initial step in the printing process is to first "sheet" the substrate material 10, that is, to separate the roll material 12 into individual sheets 14 of the desired size. Although the method may be utilized with substrate in roll form, it is preferable to unroll the material and sheet it for ease of handling. The material is removed from cold storage and trimmed into sheets of the desired size. Trimming is necessary so that the edges of the composite material do not extend beyond the edges of the backing thus minimizing possible damage. Once the individual sheets have been severed, it may be necessary to apply pressure at station 20 by means of a roll or a flat press to compress the substrate and the carrier liner. This may be accomplished by using steel or rubber rolls, applying of pressure of approximately 10 psi in order to firmly bond the backing to the composite. If the material 10 is flat as shown in Figure 12A, it may be trimmed and compressed into sheets 14A.

Once sheeting and compression has been completed, the next step in the process is to coat the upper surface with a base coating prior to application or graphics. The coating 22 is preferably a specialized UV curing ink of the type such as that sold by Nor-Cote International. The coating may be applied by brush, roller, screen-printing, spraying or any other technique at 21. The coating is then allowed to dry and cure, which is accelerated by exposing the coating to UV radiation at a source 24 having a wavelength of between 300 to 500 nanometers. Normally the drying time is relatively short, requiring only approximately a few seconds.

The prepped substrate is now ready for application of images. The application of images can be accomplished by various printing techniques. Printing may be accomplished at print station 25 by silk screening, web printing, lithography, flexography, rotogravure or even rotary letterpress. Preferably, however, printing is accomplished by lithography. In most lithography operations, the image is transferred from a printing plate to a rubber blanket and then to the substrate and, accordingly, this is the reason this type of printing operation is sometimes termed "offset." When the printing plate is exposed, an ink receptive coating is activated at the image area. The plate is dampened by ink rollers. Ink adheres to the image area and as the cylinder is rotated, the image is transferred to the blanket. The substrate passes by the blanket cylinder and the image 26 is transferred to the coated substrate 10.

It is an important aspect of the present invention that the inks utilized are in the lithography process are UV curable inks. Conventional printing inks and dyes will not adhere to the coated substrate surface. UV curable inks that are well known are those in the printing industry and such inks are available from Nobel Printing Inks, Corp. Generally UV inks have as principal components acrylate, photoinitiators, pigments, carbon black and titanium dioxide. After the images are applied, the images are then subjected to curing by exposure to UV radiation at station 27. The substrate with the desired graphic image is now returned to cold storage 28, preferably below 40° F. The printed substrate is now ready for fabrication into an end product.

EXAMPLE

In order to test the effectiveness of the process of the present invention, a large Tow carbon fiber substrate ("prepreg") was printed by a process as described above. The large Tow carbon fiber prepreg was supplied by Zoltek Materials Group and available from HST of San Diego, Calif. The carbon prepreg was 120 FAW having a 30% resin content. FAW is a term meaning "fiber areal weight" which specifies the mass of carbon fiber per square meter. 120 FAW means each square meter of material has approximately 100 grams of carbon fiber. The resin content is the weight percentage of resin. The resin was a 250° to 350° F. curing thermosetting modified epoxy. The material, as provided, was rolled on 10 inch ID cardboard core, shrink-wrap bags sealed in a box. A carrier was applied to one surface of the substrate which was a backing paper with a silicone coating. It has been found that prepreg materials in approximately the 25% to 35% resin content range in having a FAW in the 70% to 300% range work well. The material, as described above, was received and intermediately maintained in cold storage at approximately 30° F.

A prepreg, as described above, creates stiffer, stronger laminates with more predictable mechanical characteristics. Generally, the fiber is pre-impregnated with resin at the production facility, rolled onto spools and then chilled to prevent the resin from curing prematurely. The material is cut and laid into molds and generally cured by vacuum compaction and heated until the resin glass flows and it hardens into the desired shape. In some instances, the curing may also involve autoclaving to pressure cook the laminate. The cured temperature is generally between 250° to 350° F.

Once the prepreg substrate is to be printed, it is removed from cold storage and the rolled form is first sheeted. The material was trimmed into individual sheets, in this case each having a dimension of approximately 28" to 35". The edges of the backing and the substrate were trimmed so that they form a common edge so the prepreg did not extend or project beyond the edge backing. Thereafter, the individual sheets were compressed onto a carrier with pressure rolls. The pressure was approximately 10 psi and the rolls were rubber surfaced rolls.

After compression, the exposed surface of the sheets were then flood coated by silk-screening with a white opaque coating applied by screen. The coating consisted of special paint sold under the tradename UVONYL having the following composition:

Principal Components:

Acrylated oligomers

N-Vinyl-2-Pyrrolidone

Acrylated monomers

N-Vinylcaprolactam

A Mixture of:

2H-Azepin-2-one, 1 Etheny 98.5%

2H-Azepin-2-one, hexahydr 1.5%

Figure 3:
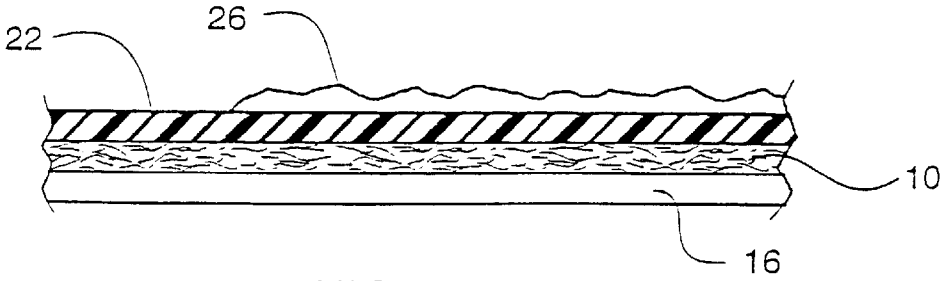
FIG. 3 is cross-section of a representative substrate to which the process has been applied.

The coating was cured by exposure to UV in the range of 350 to 400 nanometers and when cured was ready for an image to be applied to the coated substrate. The coated substrate provided the necessary background for the image, which was in the form of a repetitive camouflage design, as seen in FIG. 3.

The printing process utilized was lithography using UV curable inks in a four-color process. The inks were provided by Nobel Printing Inks and had the composition as set forth in the following table.

Specific/Generic Chemical Identity

Uretane Acrylate

Acrylate Monomer Blend

Organic Photoinitiators (TS)

Organic Pigments (TS)

Titanium Dioxide (CAS 13463-67-7)

Carbon Black (CAS 133-86-4)

Figure 2:
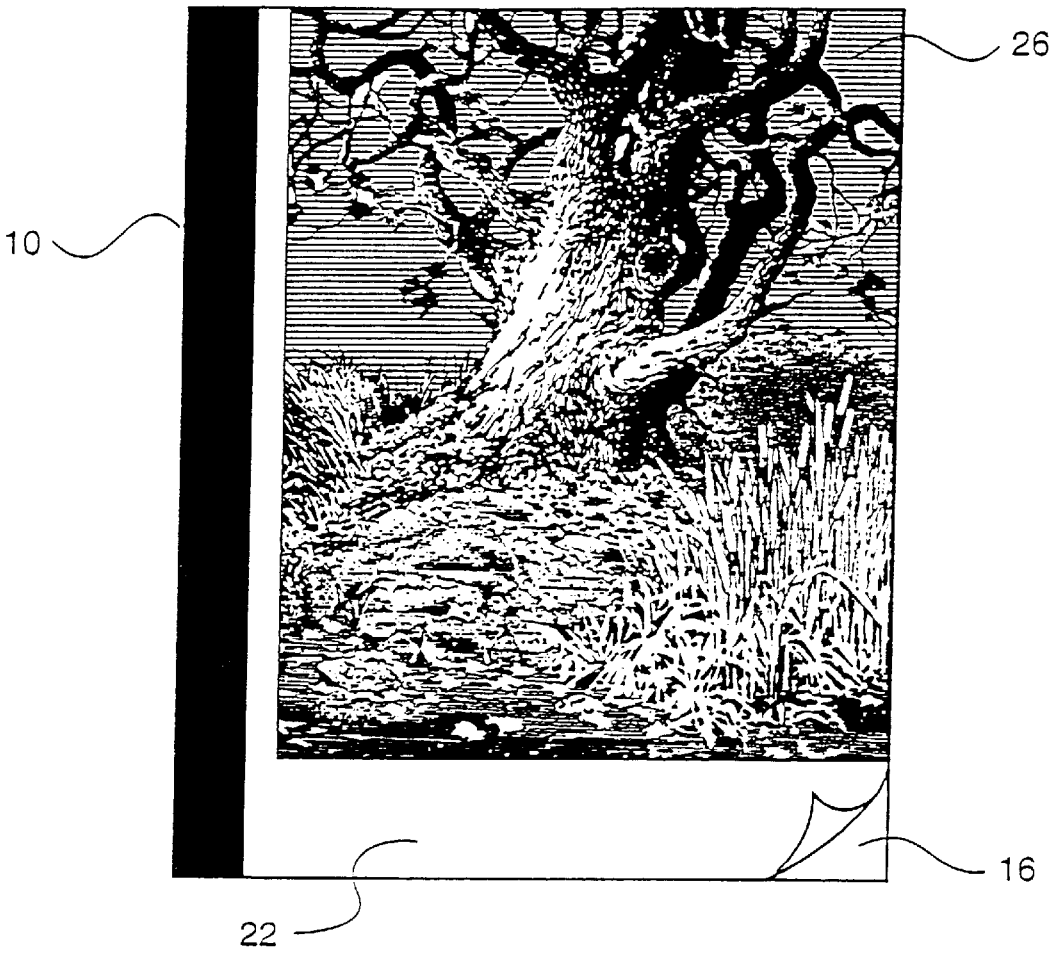
FIG. 2 is shows a substrate with a graphic applied thereto.

Once the images were applied, the inks were cured by exposure to UV radiation by IST, a company located in Germany. The resulting product was as shown in FIGS. 2 and 3 and the substrates were returned to cold storage ready for transfer to a fabricator.

Although the particular example set forth above is primarily directed to imprinting graphics design on a carbon fiber prepreg, it is to be understood that a wide variety of composite fibers, fabrics and woven products of the composite type impregnated with polymers can be printed in this manner to produce a variety of graphic effects. Accordingly, the present invention has been described in detail for the purposes of illustration in compliance with the requirements of the Patent Laws and the invention is not intended to be limited by this description except as defined by the scope of the appended claims.

It will be obvious to those skilled in the art to make various changes, alterations and modifications to the invention described herein. To the extent these various changes, alterations and modifications do not depart from the spirit and scope of the appended claims, they are intended to be encompassed therein.

We claim:

1. A method of printing on a composite substrate impregnated with a polymeric resin, said process comprising:

(a) providing a composite substrate with a top and bottom surface having a matrix impregnated with a polymeric resin;

(b) placing the substrate in a chilled condition;

(c) coating said top surface with a UV curable ink and curing same by exposure to UV radiation;

(d) printing the coated top surface with an image using an UV curable ink and curing same by exposure to UV radiation; and (e) maintaining the printed substrate in a chilled condition ready for completion into a product.

2. The method of printing on a composite of claim 1 wherein said substrate is sheeted and is subjected to compression prior to coating.

3. The method of printing on a composite of claim 1 wherein said printing is applied by a printing method selected from the group consisting of silk-screening, lithography, rotogravure and flexography.

4. The method of printing on a composite of claim 1 wherein said coating is applied by a method selected from the group consisting of painting, spraying, screening printing and brushing.

5. The method of printing on a composite of claim 1 wherein the composite substrate is a prepreg.

6. The method of printing on a composite of claim 1 wherein the substrate is a large Tow carbon fiber prepreg having approximately a 20 to 40% resin content.

7. The method of printing on a composite of claim 1 wherein said top surface is coated using an opaque light colored UV curable ink.

8. The method of printing of claim 1 wherein said substrate is provided in rolls and is first sheeted.

9. A method of printing on a composite substrate impregnated with a polymeric resin, said process comprising:

(a) providing a composite substrate with a top and bottom surface having a matrix impregnated with a polymeric resin;

(b) cooling the substrate to a temperature below about approximately 40° F.;

(c) coating said top surface with a UV curable ink and curing the ink by exposure to UV radiation having a wavelength of approximately 300 to 500 nanometers;

(d) printing the coated top surface with an image using UV curable inks and curing the ink by exposure to UV radiation having a wavelength of approximately 300 to 500 nanometers; and (e) maintaining the printed substrate in a cooled condition, below about approximately 40° F., ready for completion into a product.

10. The method of printing on a composite of claim 9 wherein said substrate is sheeted and is subjected to compression prior to printing.

11. The method of printing on a composite of claim 9 wherein said printing is applied by a printing method selected from the group consisting of silk-screening, lithography, rotogravure and flexography.

12. The method of printing on a composite of claim 9 wherein said coating is applied by a method selected from the group consisting of painting, spraying, screening printing and brushing.

13. The method of printing on a composite of claim 9 wherein the substrate is a large Tow carbon fiber prepreg having approximately 20% to 40% resin content.

14. The method of printing on a composite of claim 9 wherein said top surface is coated using an opaque light colored UV curable ink.

* * * * *